United States Patent [19]

Stuff et al.

[11] 4,203,598

[45] May 20, 1980

[54] GOLF CLUB

[75] Inventors: Alfred Stuff, Ridgewood; Anthony Pellizzi, Franklin Lakes, both of N.J.

[73] Assignee: Square Two Golf Corporation, Fairfield, N.J.

[21] Appl. No.: 842,538

[22] Filed: Oct. 17, 1977

Related U.S. Application Data

[62] Division of Ser. No. 503,474, Sep. 5, 1974, Pat. No. 4,058,312.

[51] Int. Cl.[2] ..... A63B 53/00

[52] U.S. Cl. ..... 273/77 A; 73/65; 273/80 A; 273/81 A

[58] Field of Search ..... 273/77 R, 77 A, 80 R, 273/80 A, 80 B, 81 R, 81 A, 167–175; 73/65, 66, 456–470

[56] References Cited

U.S. PATENT DOCUMENTS

| | | | |
|---|---|---|---|
| 1,516,786 | 11/1924 | Prentiss | 273/77 A |
| 1,594,801 | 8/1926 | Stackpole | 273/77 A X |
| 1,673,361 | 6/1928 | Heeter | 273/80 A |
| 2,051,083 | 8/1936 | Hart | 273/81A |
| 2,628,099 | 2/1953 | Murphy | 273/81 A X |
| 3,606,327 | 9/1971 | Gorman | 273/81 A |
| 3,809,403 | 5/1974 | Hunter | 273/80 B |
| 4,058,312 | 11/1977 | Stuff et al. | 273/77 A |

FOREIGN PATENT DOCUMENTS

| | | | |
|---|---|---|---|
| 1261541 | 1/1972 | United Kingdom | 273/80 R |

*Primary Examiner*—Richard J. Apley
*Attorney, Agent, or Firm*—Thomas E. Spath

[57] ABSTRACT

An improved method of determining the true swing weight of a golf club is provided by balancing the club at a fulcrum located under the shaft at a point approximately five inches from the tip of the grip end of the shaft. All of the golf clubs in a set are matched to each other on the basis of (a) total club weight; (b) the location of the club's center of gravity at a point on the shaft which is a constant distance from the tip of the grip end of each club; (c) true swing weight. This matching is accomplished while accounting for the effects of an additional component weight placed in the grip end of the shaft, displaced radially from the shaft axis. This additional component weight also produces a countering force to the torquing forces which act to resist the golfer's efforts to bring the club face into proper alignment for impact during the latter part of the downswing. This additional component weight also tends to counter the precessional forces on the head which develop during the swinging of the club. A club design is also disclosed which results in the location of the center for percussion for the moving club at a position closer to the point of impact of the club face with the ball.

5 Claims, 16 Drawing Figures

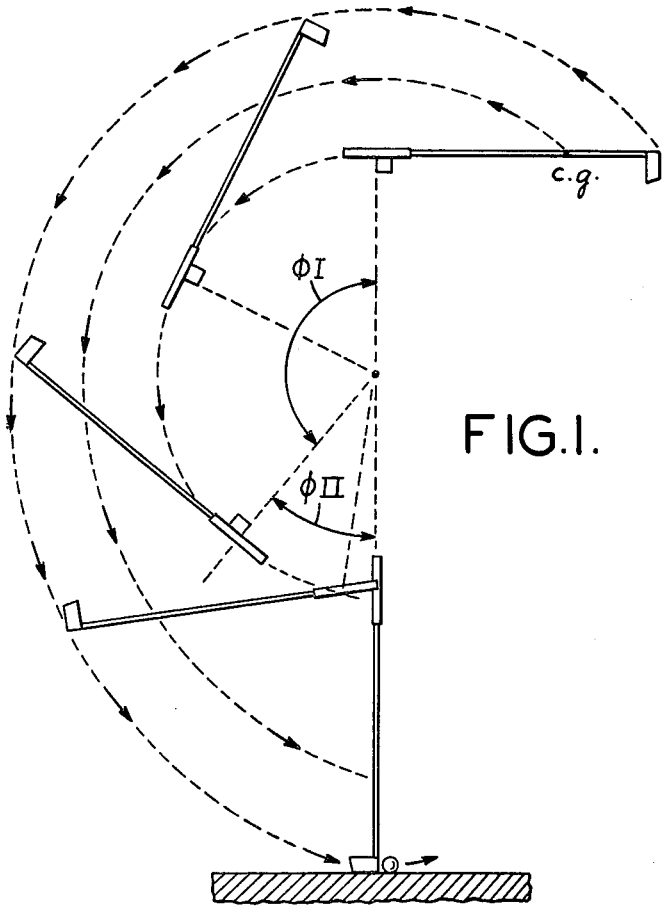
FIG.1.
FIG.2.
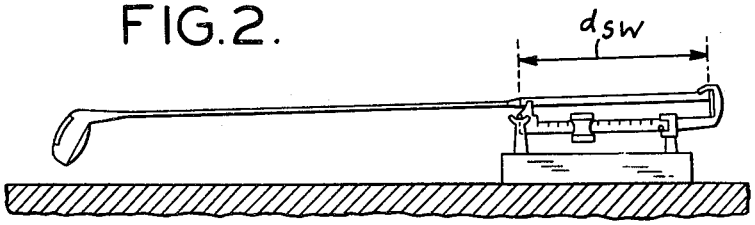
FIG.3.
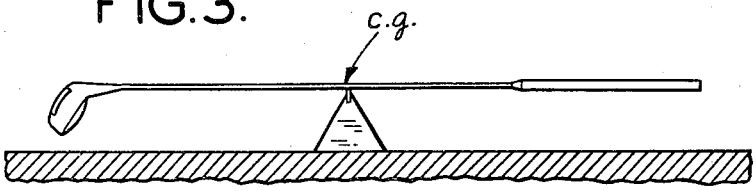

FIG.7D. $x_o \rightarrow F_x$
$\theta \cong o°; F_x \sin\theta \cong o$

GOLF CLUB

This application is a division of our co-pending application U.S. Ser. No. 503,474 filed Sept. 5, 1974 now U.S. Pat. No. 4,058,312.

BACKGROUND OF THE INVENTION

Full sets of golf clubs are available featuring variations in design and construction which are suited to the individual golfer's physical size and strength. As a minimum, quality factory-made clubs provide for at least the three variables of shaft-flex, over-all length and swing weight. In addition to these three basic variables it is also known to custom fit a set of clubs to the needs of a specific individual golfer by variations in the weight of the club head, the weight of the shaft, the total weight of the club, the loft of the club face, angle of the face of the wood clubs to the shaft (i.e., either open or closed), the club lie and the size and shape of the grip.

Given all of these possible parameters it is obvious that even one club, be it a wood or an iron, could be produced in a limitless number of variations. However, if the specific requirements of a given individual are applied, such as stance, grip, height, and strength, many of these parameters become fixed within narrow ranges and the design specifications for a club can be fixed which will give the golfer a good fit. Having determined the optimum specifications for one club in the set, it is possible to apply these to the other clubs and produce a so-called matched set. The clubs of this matched set are designed to "feel" alike or "swing" alike.

As noted above, the swing weight of a club is one of the variable design parameters to be determined according to the individual golfer's requirements. It is generally accepted that the swing weight of the clubs in a matched set should be the same. The swing weight of a given club is determined by placing the club across a knife-edge or fulcrum located at an arbitrary fixed distance $d_{sw}$ from the grip end of the shaft and placing sufficient weight at the very tip of the grip end of the shaft to balance the club. This weight is then the swing weight.

It is presently the practice in the industry that the swing weight shall be determined by locating the fulcrum at a distance $d_{sw}$ of either twelve or fourteen inches from the grip end of the shaft. The older and original method of determining the swing weight was on the Lorythmic scale in which the fulcrum was fourteen inches from the tip of the grip end of the shaft.

The essential element in the game of golf is control. Control implies that a golfer may achieve predictable and consistent results using the same club to hit the same or equivalent ball. When the swing weights of a set of clubs are properly matched the golfer will experience the same subjective feel in swinging all of his clubs, whether irons or woods. Under these circumstances the golfer is able to develop and master one good swing which need not be varied with each club or type of club he happens to be swinging.

It is therefore an object of our invention to provide a method for improving the dynamic performance characteristics of a golf club and further to provide a method of more accurately matching the clubs in a set so that the clubs swing, or 'feel', alike.

It is a further object of our invention to provide clubs incorporating novel design features which produce dynamic forces during the club swing which aid the golfer in his efforts to control the club movement.

The invention is hereinafter described in the specification and with reference to the accompanying drawings, in which, FIG. 1 is a view normal to the swing plane showing the sequential movement of a golf club in the plane;

FIG. 2 is a side view of an apparatus for measuring the swing weight of the club;

FIG. 3 is a side view of an apparatus for determining the center of gravity of a club along the shaft of the club;

Figure 4:
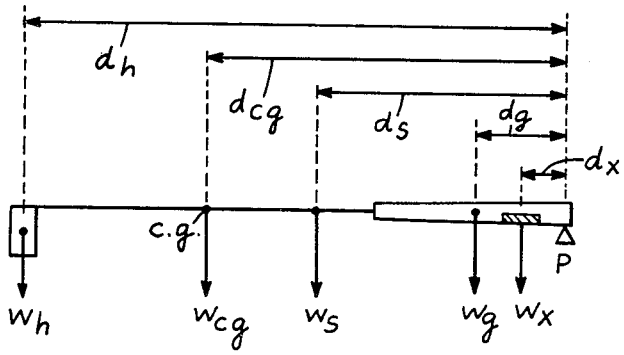
FIG. 4 is a schematic representation of the effective weights of the club components and effective distances from their centers of gravity to an arbitrary point P located at the grip end of the club.

What we have found is that a realistic analysis of the dynamic forces acting on the moving golf club may be undertaken by assuming that the club shaft moves in a plane rotating axially about a central point as shown sequentially in FIG. 1. This plane is, of course, inclined from the horizontal, the angle of inclination varying depending upon the individual golfer's physical characteristics. The initial position of the club in FIG. 1 is at the top of the backswing. Based on studies of high-speed photographs of numerous golfers' swings, the wrists are cocked and the hands and club accelerate through ΦI, or Phase I of the downswing in the cocked position. During ΦII, or Phase II, of the downswing, the wrists uncock and are brought to the straight position for impact with the ball. The following generalizations can be made about the movements of the club: (a) a point on the grip located between the golfer's hands will describe an arc of relatively constant radius about the central point or principal axis; (b) a radial to this point will be approximately normal to the grip through a first phase of the downswing; (c) the entire club undergoes increasing radial acceleration during the first phase, or ΦI of the downswing; (d) during a second phase, or ΦII, of the downswing the grip end of the club undergoes a rapid deceleration about the principal axis of the plane, and at the same time the head of the club reaches its peak acceleration due to the additional rotation about an axis located approximately between the golfer's hands on the club shaft; and (e) during this second phase the head also rotates approximately 90° about the axis of the shaft to the square position at impact.

The time it takes the club to move through the first and second phase is approximately equal. Phase two, or the second phase, corresponds to the period during which the golfer's wrists uncock and terminates at the moment of impact with the ball.

What we have found from studies of the swing dynamics of the golf club is that the matching of the swing weight of a set of clubs on the basis of measurements taken twelve inches or fourteen inches from the grip end of the shaft is not the optimum means of providing clubs which feel or swing alike in the hands of the golfer. FIG. 2 shows a device commonly used to determine the swing weight. The location of the fulcrum is a distance $d_{sw}$ from the end of the grip. The device can be constructed so that actual weight in ounces or grams can be read from the scale, or the scale can be calibrated in arbitrary figures. What we have found is that when the swing weight is measured by placing the club shaft on a fulcrum located at a distance $d_{sw}$ of approximately five inches from the tip of the grip end of the shaft, and all clubs in the set are produced with this same "true swing weight" a noticeable improvement in the uniformity of feel or swing is felt by the golfer. The term "true swing weight" will be used hereafter to distinguish our method using a distance $d_{sw}$ of five inches from those of the prior art where the distance $d_{sw}$ was set at twelve or fourteen inches. It is believed that matching true swing weights at a distance $d_{sw}$ of five inches results in improved swing feel and control for the matched set because it is at about the five inch position that the golfer's hands are centered. As stated above, it is this point about which the secondary rotation occurs during Phase II of the swing. Thus, when the hands take the club by the grip the weight of the club and the various dynamic forces exerted on the components of the club are felt at this point by the golfer. While it is appreciated that the position of the fulcrum, or the distance $d_{sw}$ for determining the true swing weight for a particular golfer may vary depending upon the method of gripping the club, the size of the golfer's hands and other individual preferences, the distance $d_{sw}$ of five inches has been determined to provide the optimum average or standard for the practical purposes and limitations involved in club design and manufacture. Club sets matched on the basis of our true swing weight provide the golfer with improved control and effectiveness by virtue of a more uniform feel or swing as between all clubs of the set.

The above described method of determining the true swing weight for a given club, and then matching all clubs in the set to the same true swing weight results in significant improvements over clubs and sets of club of the prior art. However, substantially greater benefits are realized when the entire set of clubs is matched on the basis of total club weight and the location of the club center of gravity at a fixed distance $d_{cg}$ from the grip end of the shaft, in addition to being matched for true swing weight.

The total weight of the club can be measured by any accurate balance or spring scale, and the center of gravity as measured on the club shaft is determined as shown in FIG. 3 by placing the club shaft on a knife-edge located so that the shaft is maintained in essentially horizontal static balance. This point on the shaft is an approximation of the center of gravity for the club, and has been found by us to be a significant parameter in terms of improving the dynamic performance of the club in the golfer's hands.

This principle of matching total club weight in a standard set of matched clubs has not been generally adopted. While a uniform swing weight between clubs in matched sets using the twelve or fourteen inch fulcrum balancing method has been widely adopted by club designers, little or no effort has been made to provide a uniform total weight as between all the clubs.

The data of Chart I below is a comparison of the parameters of true swing weight (i.e., at the five inch point), swing weight at twelve inches, total weight of the club and location of the center of gravity on the club shaft as measured from the grip end. Data in Column A represents clubs constructed by us according to our invention; Columns X Y and Z are measurements that were taken from commercially available clubs sold by three well-known and competing American companies. Matching of total weight is important since it is the total weight the golfer feels throughout the swing and is the primary factor in Phase I of the downswing. During Phase II the dynamic forces are most significant and the swing weight is primarily felt.

There are three basic components in the standard golf club, the weights of which when combined give the total weight of the club. These are the head, the shaft and the grip. We have found that it is advantageous to add a fourth component to the club—a weight $W_x$ placed at the grip end of the shaft—in order to be able to accomplish the complete matching of total club weights and center of gravity along the shaft between all clubs of the set.

CHART I

| | Club Set "A" | | | | Club Set "X" | | | | Club Set "Y" | | | | Club Set "Z" | | | |
|---|---|---|---|---|---|---|---|---|---|---|---|---|---|---|---|---|
| | SWING WEIGHT | | TOTAL WT. | CENTER GRAVITY | SWING WEIGHT | | TOTAL WT. | CENTER GRAVITY | SWING WEIGHT | | TOTAL WT. | CENTER GRAVITY | SWING WEIGHT | | TOTAL WT. | CENTER GRAVITY |
| | 5" | 12" | gms. | " | 5" | 12" | gms. | " | 5" | 12" | gms. | " | 5" | 12" | gms. | " |
| WOODS | | | | | | | | | | | | | | | | |
| #2 | 23.1 | 18.75 | 445 | 26.00 | 23.5 | 20.55 | 377 | 30.50 | 23.2 | 20.45 | 364 | 31.00 | 23.1 | 20.20 | 373 | 30.25 |
| #5 | 23.1 | 18.80 | 441 | 26.13 | 23.2 | 20.20 | 377 | 30.50 | 23.4 | 20.40 | 379 | 30.25 | 23.6 | 20.45 | 386 | 29.75 |
| IRONS | | | | | | | | | | | | | | | | |
| #3 | 23.1 | 18.75 | 444 | 26.00 | 24.6 | 20.70 | 421 | 28.75 | 24.1 | 20.50 | 407 | 29.25 | 24.4 | 20.55 | 419 | 2.50 |
| #6 | 23.1 | 18.80 | 445 | 26.00 | 24.7 | 20.50 | 436 | 28.00 | 24.6 | 20.70 | 426 | 28.50 | 25.0 | 20.70 | 440 | 27.75 |
| #9 | 23.1 | 18.85 | 440 | 26.13 | 25.2 | 20.65 | 456 | 27.50 | 25.2 | 20.80 | 444 | 27.75 | 25.5 | 20.80 | 461 | 27.00 |
| VARIATION | 0 | 0.1 | 6.0 | 0.13 | 2.0 | 0.5 | 79 | 3.0 | 2.0 | 0.4 | 80 | 3.13 | 2.4 | 0.6 | 88 | 3.25 |
| PERCENTAGE | (1) | (2) | 1.4% | 0.5% | (3) | (4) | 20.7% | 10.9% | (3) | (4) | 22.0% | 11.3% | (3) | (4) | 23.6% | 11.6% |

CHART I-continued

| | Club Set "A" | | | | Club Set "X" | | | | Club Set "Y" | | | | Club Set "Z" | | | |
|---|---|---|---|---|---|---|---|---|---|---|---|---|---|---|---|---|
| | SWING WEIGHT | | TOTAL WT. | CENTER GRAVITY | SWING WEIGHT | | TOTAL WT. | CENTER GRAVITY | SWING WEIGHT | | TOTAL WT. | CENTER GRAVITY | SWING WEIGHT | | TOTAL WT. | CENTER GRAVITY |
| | 5" | 12" | gms. | " | 5" | 12" | gms. | " | 5" | 12" | gms. | " | 5" | 12" | gms. | " |
| VARIATION | | | | | | | | | | | | | | | | |

(1) Medium "True" swing weight with negligible variation.
(2) Also matches on standard swing weight scale. Indicates a light swing weight for a relatively heavier club when compared to standard clubs.
(3) Wide variation of "True" swing weight for standard clubs. Swing balance ranges from a medium to very heavy within a given set.
(4) Standard clubs have a relatively wide tolerance given when measured on a standard scale.

The determination of the size of this weight $W_x$ and its location along the shaft permits us to obtain the combined matching of clubs on the basis of swing weight, total weight and center of gravity.

The amount of the weight $W_x$ to be added to the grip end of the club and its location along the shaft are determined by solving equations describing the golf club in which certain parameters are fixed. With reference to FIG. 4, the forces acting on the system about the pivot or fulcrum point P are as follows, where the weights, W, of the components are assumed to be located at their respective centers of gravity, and the distances, d, are measured from the point P located at the very end of the grip:

$W_h$=weight of the club head
$W_s$=weight of the shaft
$W_g$=weight of the grip
$W_x$=weight of added component in grip end of club shaft
$W_{cg}$=equivalent weight of all the components of club $$W_{cg}d_{cg}=W_hd_h+W_sd_s+W_gd_g+W_xd_x$$

The above equation is based on the proposition that the club components can be represented as an equivalent weight, $W_{cg}$ acting at a given distance $d_{cg}$ from the fulcrum P.

Figure 5:
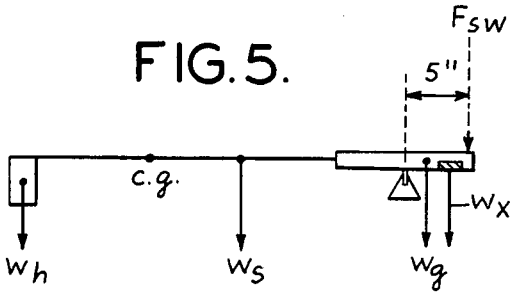
FIG. 5 is a schematic representation of a swing weight balance scale comparable to that shown in FIG. 2, where the fulcrum is located at a distance of five inches in from the grip end of the club the respective distances being measured from the component centers of gravity to this fulcrum.

With reference to FIG. 5, the forces acting to maintain the club in static balance about the fulcrum located five inches from the grip end of the club shaft are represented by the following equation, where the distance d' is measured from the fulcrum, that is, $d'=(d-5)$; and the weights are taken to be acting at the center of gravity of the respective components as defined above;

As we have previously stated optimum performance of the clubs is obtained if the swing weight as measured at the five inch fulcrum is a constant. Therefore, the product $$W_hd'_h+W_sd'_s+W_gd'_g+W_xd'_x-F_{sw}\times 5=0=\text{sum of torques} \quad (2)$$

$$F_{sw}\times 5=K_{sw} \quad (2')$$

$$W_hd'h+W_sd'_s+W_gd'_g+W_xd'_x=F_{sw}\times 5=K_{sw} \quad (2'')$$

where $K_{sw}$ will also be a constant which can be defined for all of the clubs in a given set.

Also as we have previously stated the total weight of each club in the set must be same as for all other clubs, and the center of gravity for all clubs must be located at about the same distance from the grip end of each shaft. These relations may be expressed as follows, where $K_w$ is a constant, being the total weight of each club of the set; and $d_{cg}$ is a constant, being the distance of the center of gravity from the grip end of the shaft:

$$K_w=W_x+W_g+W_s+W_h \quad (3)$$

and substituting in equation (1), above, where $d=d'+5$:

$$K_w(d'_{cg}+5)=(d'_x+5)W_x+(d'_g+5)W_g+(d'_s+5)W_s+(d'_h+5)W_h \quad (4)$$

where $d'_{cg}+5$ is a constant and its product with $K_w$ is a constant $K_{cg}$.

$$K_{cg}=(d'_x+5)W_x+(d'_g+5)W_g+(d'_s+5)W_s+(d'_h+5)W_h \quad (5)$$

For all of the clubs in a given set, the weight of the grip, $W_g$, and the location of its center of gravity, $d_g$, can be assumed to be constant and, therefore, their product is also a constant, $K_g$ for all clubs:

$$W_gd'_g=K_g \text{ and } W_g(d'+5)=K'_g \text{ andd } W_g=K_{wg} \quad (6)$$

The shaft weight $W_s$ and the location of gravity, $d_s$, can be determined, although these will vary with the length of the shaft, which decreases down through the woods and irons. These weights and distances can be represented for the various clubs in the set, and their products determined, as follows:

$$W_{sa}\cdot d'_{sa}, \text{ where } a=1,2,3\ldots n \quad (7)$$

where a represents the number of a given wood or iron, n being the total number of clubs in the set.

The final term of the equation which can be calculated for each club in the set is $$W_{ha}\cdot d'_{ha} \text{ where } a=1,2,3\ldots n \quad (8)$$

where a and n are defined as in equation (7) above.

Having established there relationships and the constants, and substituting equations (6), (7) and (8) into equations (2''), (3) and (5) can be rewritten as follows:

$$K_{sw}=d'_{xa}W_{xa}+K_g+d'_{sa}W_{sa}+d'_{ha}W_{ha} \quad (9)$$

$$K_w=W_{xa}+K_{wg}+W_{sa}+W_{ha} \quad (10)$$

$$K_{cg}=(d'_{xa}+5)W_{xa}+(d'_{sa}+5)W_{sa}+K_g'+(d'_{ha}+5)W_{ha} \quad (11)$$

These are the general equations governing the matching of the clubs in a given set. It is to be understood that the terms $d'_{sa}$, $W_{sa}$ and $d'_{ha}$ will be pre-determined by the respective components used. As has been demonstrated, the variables to be determined in order to achieve matching are $d_{xa}'$, $W_{xa}$ and $W_{ha}$.

Since the distance $d_x$ is relatively small, the true swing weight $K_{sw}$ is largely determined by the value of $W_h$, the weight of the head.

The total weight constant $K_w$ of the club is largely determined by the additional weight component $W_x$. The $K_{cg}$ constant is determined by $W_h$ and $W_x$ for a given set.

As will be appreciated by one skilled in the art the value of the constants $K_{sw}$ and $K_w$ are selected to provide the dynamic performance characteristics to meet the needs of the individual golfer. As will also be appreciated by one skilled in the art these constants will also be arbitrarily selected base on shaft length and the generally accepted variations between men's and women's clubs, each of which are further classified as 'light', 'medium' and 'heavy'.

The location $d_x$ and mass of the weight $W_x$ is determined by dynamic considerations which will be discussed in further detail below.

The minimum total weight $K_w$ for a given true swing weight $K_{sw}$ is determined by the shortest club in the set, which generally will be the nine iron or the wedge, which club can be provided with no additional weight component at the grip end of the shaft.

However, for a given $K_{sw}$ and shaft component, K can be selected to have almost any value above the minimum.

Once the $K_{sw}$ and $K_w$ constants are chosen for a given set, then a unique center of gravity $K_{cg}$ is also fixed.

With these constants fixed, and with reference to the general equations (9), (10) and (11) above, the values of $W_{xa}$ and $W_{ha}$ can be calculated for each club in the set.

We have thus provided an analytical method which will enable one reasonably skilled in the art to practice our invention to produce a set of golf clubs all of which are matched to each other on the basis of (a) total club weight; (b) the location of the center of gravity of each and every club at a point on the shaft which is a constant distance from the tip of the grip end of the shaft, and (c) true swing weight, as we have previously defined that term.

It is apparent that the set of clubs matched in accordance with our invention will also have a constant swing weight when measured either on the Lorythmic scale with a fulcrum at fourteen inches or on a scale having its fulcrum at twelve inches from the grip end of the club. This result occurs because the center of gravity of all clubs in the set is located at a constant distance from the grip end of the clubs. With reference to equation (1) where $d_{cg}$ and $W_{cg}$ are constant for a given set of clubs, the balance taken on any swing weight scale will be a constant, i.e., for equation (2'):

$$F_{SW5''} \times 5 = K_{SW5}$$

$$F_{SW12''} \times 12 = K_{SW12''}$$

$$F_{SW14''} \times 14 = K_{SW14''}$$

It should be understood, of course, that while the swing weights within the set are a constant for a given fulcrum location, the absolute values measured by the scales will not be the same constant. It will be appreciated that a particular advantage of the clubs constructed in accordance with our invention, is that the golfer can himself vary the effective swing weight which he feels merely by 'choking up' or 'letting out' on the grip from his normal gripping position. If this choking up or departure from his usual grip is consistent with each club that he uses the swing weights will remain constant.

In accordance with the above teachings and by way of example, a set of clubs is constructed which has a fixed arbitrary true swing weight of 23.4 units as measured on a device constructed as shown in FIG. 2, where $d_{sw}$ is five inches. The club set having this true swing weight and of the shaft lengths selected would fall within the general classification of 'men's medium' as that term is used and understood by those familiar with the art. The various parameters for this particular set of clubs is tabulated below in Chart II. A standard steel shaft is used for woods and irons, being cut to length as indicated in the first column. As it is the customary practice in the industry, standard grips were also used for the clubs, the weight of the grips being about 47 grams. This amount of weight, when added together with the weights of the components shown in the respective columns of Chart II provide the total weight, $W_T$, in the last column. For this particular set, and by way of example, the last club in the set, i.e., the wedge, was provided with no additional weight component $W_x$. It will also be appreciated that the amounts and positions of weights $W_x$ at the distances $d_x$ shown in Chart II is also arbitrary, in that selection of materials of different densities and configurations, can be made to provide the desired total matching.

Club sets matched in accordance with the above teachings incorporating the additional weight component in the grip end of the shaft will provide the golfer with improved control and effectiveness by virtue of a more uniform feel or swing between all clubs of the set. An analytical method for determining the amount of weight and its location relative to the grip endd of the shaft has been provided.

CHART II

| | SHAFT LENGTH inches | SHAFT WEIGHT $W_g$ gms. | HEAD WEIGHT $W_h$ gms. | CENTER OF GRAVITY $d_{cg}$ inches | $W_x$ gms. | $d_x$ inches | WEIGHT $W_g$ gms. |
|---|---|---|---|---|---|---|---|
| WOODS | | | | | | | |
| #1 | 43 | 120 | 195 | 27 | 78 | 3½ | 440 |
| #3 | 42 | 118 | 206 | 27 | 68 | 3½ | 439 |
| #4 | 41½ | 117 | 210 | 27 | 64 | 3 | 438 |
| #5 | 41 | 115 | 218 | 27 | 59 | 3 | 439 |
| IRONS | | | | | | | |
| #2 | 38½ | 121 | 238 | 27 | 34 | 2½ | 440 |
| #3 | 38 | 119 | 244 | 27 | 28 | 2½ | 438 |
| #4 | 37½ | 117 | 251 | 27 | 25 | 2 | 440 |
| #5 | 37 | 117 | 253 | 27 | 23 | 2 | 440 |
| #6 | 36½ | 115 | 257 | 27 | 19 | 1¾ | 438 |
| #7 | 36 | 113 | 263 | 27 | 15 | 1¾ | 438 |
| #8 | 35½ | 112 | 270 | 26.9 | 9 | 1½ | 438 |

CHART II-continued

| | SHAFT LENGTH inches | SHAFT WEIGHT $W_g$ gms. | HEAD WEIGHT $W_h$ gms. | CENTER OF GRAVITY $d_{cg}$ inches | $W_x$ gms. | $d_x$ inches | WEIGHT $W_g$ gms. |
|---|---|---|---|---|---|---|---|
| #9 | 35 | 111 | 277 | 27 | 4 | 1½ | 439 |
| W | 34½ | 111 | 280 | 27 | 0 | — | 438 |

(1) Grip Weight, $W_g$ = 47 gms. for all clubs
(2) True Swing Weight = 23.4 units for all clubs Obviously, empirical methods can be employed to arrive at a set of clubs which are so matched. Such a method employs static balancing of the clubs and the addition or removal of incremental weights from the various components of the club until the described characteristics are obtained.

In addition to the demonstrated advantages that can be derived from the balancing under static conditions which we have described above, we have found other optimum design features can serve to further improve the club's performance when the club is subjected to the dynamic forces developed during the swing and prior to impact with the ball. These can be applied individually or in conjunction with the above concepts.

These design features have been incorporated with the general principle in mind that the dynamic forces acting on any given club should be neutralized or minimized if they result in any of the following: (a) tend to move the club, or its center of gravity, out of the swing plane, or (b) tend to resist necessary club face alignment, or (c) exert a torque on, or cause flexing of the shaft in a direction other than in the swing plane. Neutralizing or minimizing these forces makes the club easier to control.

In particular, we have found that the placement of the additional component weight $W_x$ at the grip end can serve to neutralize or decrease torquing forces on the moving club which tend to displace the club from proper alignment for impact.

Figure 6:
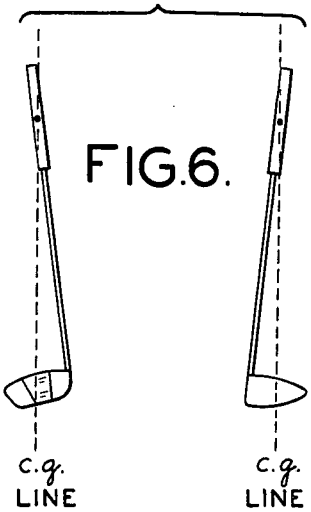
FIG. 6 is a schematic representation of a club suspended from gimbals located at the five inch point showing generally the location of the center of gravity planes perpendicular and parallel to the club face.

Using the analytical or empirical methods described above, static balancing can be achieved by varying the mass of the additional weight component $W_x$ in conjunction with its position along the longitudinal axis of the shaft. While this static balancing is an important consideration in improving control, we have found that further important and advantageous dynamic effects can be produced if the weight $W_x$ and its center of gravity are displaced radially from the longitudinal central axis of the shaft, this displacement being in the same direction relative to the shaft as the club head. Shown in FIG. 6, is a club suspended from gimbals located at about five inches from the grip end. The vertical lines passing through the head indicate the planes in which the center of gravity of the entire club lie. It will be appreciated from FIG. 6 that the center of gravity of the club lies outside of any of the components of the club.

Figure 7B:
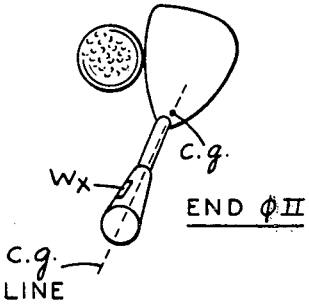
FIGS. 7A and 7B are perspective views looking down on the club shaft toward the top of the club head, showing respectively, the position of the club as it enters Phase II of the downswing, and at impact with the ball.
Figure 7A:
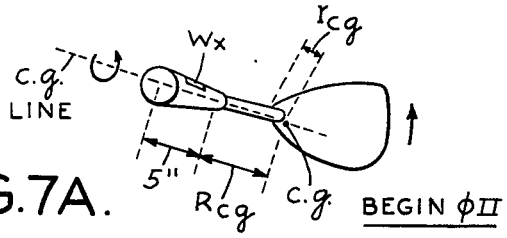

The FIGS. 7A and 7B represent the club moving through Phase II of the downswing, FIG. 7A illustrating the club face parallel to the swing plane; and FIG. 7B the club face having rotated 90° for impact with the ball. With reference to FIG. 1, it can be seen that the club position and alignment is essentially the same with respect to the swing plane during Phase I, and measurements indicate that the angular acceleration in this phase is small as compared to Phase II. Thus, the axial torquing forces acting on the shaft of the club, and which the golfer must control or overcome are relatively slight during Phase I and do not really present a problem because club motion is initiated and controlled by the large body muscles. Relatively larger torquing forces are produced in Phase II, however, which forces must be counter-acted or controlled by the weaker muscles of the golfer's forearms and hands.

As the club enters Phase II the golfer must begin the rotation of the club head and face about the axis of the shaft. Initially the torquing forces will aid or start this motion, until the club center of gravity lies in the swing plane, but beyond this point the torquing forces resist the continuing realignment of the club face to the 90° position required at impact, as shown in force diagrams 7C and E.

For a simplified model of the club, assume an equivalent mass $m_c$ at the center of gravity of the club, without a weight $W_x$ applied. The following equation describes the system, the terms being defined hereafter:

$$F=m_c a_{tcg};\ \text{where } a_{tcg}=R_{cg}\alpha r \tag{12}$$

$$F=m_c R_{cg}\alpha r \tag{13}$$

$$T_c=r_{cg}F\sin\theta \tag{14}$$

Substituting (13) into (14):

$$T_c=r_{cg}m_c R_{cg}\alpha_R\sin\theta \tag{15}$$

where $m_c$=mass of club $a_{tcg}$=trangential acceleration of $m_c$ taken at center of gravity.

$R_{cg}$=radical distance of center of gravity from 5" point at grip end, i.e., the secondary axis of FIG. 1

$\alpha r$=angular acceleration of club about 5" point.

F=acceleration force exerted on the equivalent club mass at the center of gravity.

$T_c$=torque about the club shaft.

$\theta$=angle between the $r_{cg}$ and the swing plane.

$r_{cg}$=radial distance of center of gravity from club shaft axis.

With reference to FIG. 7A it can be seen that the initial effect of $T_c$ is generally in a direction which starts the club face moving in the proper direction. However, as soon as $\theta$ goes to zero, and then starts increasing in the other direction, the torque reverses and resists the golfer's efforts to continue rotating the club face to the 90° position required for striking the ball squarely as shown in FIG. 7B. This occurs as the angular acceleration $\alpha r$ or the club is reaching its highest value resulting in force F reaching its greatest magnitude while sin $\theta$ is also approaching a maximum. This effect explains the problem encountered by the average golfer of striking the ball with an open face or "slicing".

From equation (15) it can be seen that the torque $T_c$ can be reduced to zero by a club design in which $r_{cg}=0$, that is, the center of gravity lies on the axis of the club shaft. This can be accomplished by having the axis of the shaft pass through the center of gravity of the head. However, the use of a club with this design is prohibited in tournaments sanctioned by the U.S.G.A. The Rules of Golf promulgated by the U.S.G.A. specify the permissible distance between the axis of the shaft and heel of the club. This rule applies to all clubs except the putter, which is advantageously constructed to eliminate torquing forces by having the axis of the shaft pass through the center of gravity of the club head.

Figure 7E:
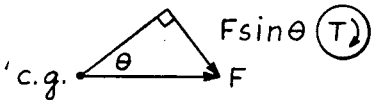
FIGS. 7D through 7F are schematic force diagrams for club components relating to the conditions shown in FIGS. 7A and 7B.
Figure 7C:
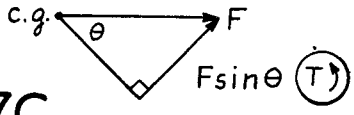
Figure 7F:
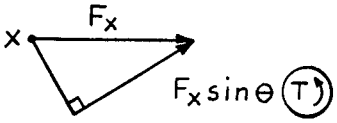

Based on measurements and the dynamics of the swing as represented in FIG. 1, the grip end of the club accelerates throughout Phase I, and on entering Phase II begins decelerating and loses most of the velocity over a much shorter arc. Thus, the negative acceleration of Phase II is several times that of Phase I and a weight $W_x$ located as shown in FIGS. 7A and 7B exerts a counter-torque as shown in force diagrams of FIGS. 7D and 7F.

In addition to the force associated with this deceleration of the grip end of the club about the principal axis of the swing, there is also a force developed as the grip end of the club undergoes an acceleration about the five inch point, or the point between the golfer's hands on the grip. When the additional weight component $W_x$ is affixed in the grip end of the shaft the total torquing forces can be decreased. The net effect of the $F_x$ associated with $W_x$ will be additive with respect to the component parts of the force vector developed by deceleration about the principal axis and the acceleration about the five inch point and will be opposite to the torque $T_c$ of equation (14).

Thus, the net torque transmitted to the golfer at the grip will be the torque $T_c$ less the torque $T_{Wx}$ produced by the additional weight component $W_x$, or $$T_{net}=T_c-T_{Wx} \tag{16}$$

The torque $T_{Wx}$ and the controlling parameters are determined in accordance with the following equations, in which the symbols denoted by a single prime (') relate to measurements with respect to the principal axis of the swing, and the double prime (") to the secondary axis or the 5" point at the grip end of the shaft. The terms of the equations are defined below and with reference to FIGS. 7D and F.

$$F_x=F_x+F'_x \tag{17}$$

$$F_x=m_x a'_{tx}+m_x a''_{tx} \tag{17}$$

wherein $F_x$=total accelerational force produced $m_x$=mass of weight component $W_x$ $a_{tx}$=tangential acceleration of $W_x$ about the respective axes.

Tangential acceleration components can be expressed as:

$$a'_{tx}=R'_x\alpha' \tag{19}$$

$$a''_{tx}=R''_x\alpha'' \tag{20}$$

Note $\alpha''=\alpha r$ defined above in equation (15)

where $R_x$=radial distance of the weight $W_x$ from the respective axes of rotation $\alpha$=angular acceleration (radians) about the respective axes Just as the total accelerational force $F_x$ can be written as the sum of the two component forces $F'_x$ and $F''_x$, so the total torque $T_{Wx}$ is also the sum produced by the rotation about the two axes, or:

$$T_{Wx}=T'_x+T''_x \tag{21}$$

The respective torques T can be represented by the equation $$T_{Wx}=r_xF'_x \sin\theta+r_xF'' \sin\theta \tag{22}$$

where $r_x$=radius of $m_x$ from the axis of the club shaft $\theta$=the angle between $r_x$ and the swing plane Substituting equations (18), (19) and (20) into equation (22)

$$T_{Wx}=r_xm_xR'_x\alpha' \sin\theta+r_xm_xR''_x\alpha'' \sin\theta$$

or $$T_{Wx}=r_xm_x \sin\theta\,(R'_x\alpha'+R''_x\alpha'') \tag{23}$$

With reference to equation (16), the following substitution can now be made utilizing the dynamic parameters developed from equations (15) and (23):

$$T_{net}=r_{cg}m_cR_{cg}\alpha_r \sin\theta-r_xm_x \sin\theta\,(R'_x\alpha'+R''_x\alpha r) \tag{24}$$

As shown by equation (24) $r_x$, $m_x$, $R'_x$ and $R''_x$, all of which are related to the amount and placement of weight $W_x$, control the neutralization of torque produced by the pronation of the club.

For any given club, the weight or mass of $W_x$ and its location can be determined to totally neutralize $T_c$ torquing forces at the grip. However, if taken in conjunction with other factors such as matching and practical considerations imposed on club design, $W_x$ can be fixed at a lesser value than is required to make $T_{net}=0$. However, by making $r_x$ and $R_x$ the maximum permitted by the physical constraints of the club $T_{net}$ can be minimized.

Again with reference to FIGS. 7A and 7B, at the beginning of Phase II of the swing a positive torque exists which starts the club in motion, and $T_{Wx}=0$. As the center of gravity of the club enters the swing phase $T_c$ goes to zero and $T_{Wx}$ provides a positive torque. This condition is represented by the equations of FIG. 7D. As the center of gravity of the club passes through the swing plane, $T_c$ increases and is now resisting proper club alignment, but is minimized by appropriately positioned $W_x$ which produces an increasing torque $T_{Wx}$ opposite to $T_c$. These conditions are represented in the force diagrams of FIGS. 7C, 7E and 7F.

A further important factor in club design which will improve the performance of the club in the golfer's hands is the location of the center of percussion as close as possible to the position at which the club face strikes the ball. The center of percussion of a suspended body is defined as the point at which it can be struck to produce a purely rotational movement about the axis of suspension without producing any translational movement. If the suspended body is struck at a point other than the center of percussion, energy is lost to translational movements of the body; or where the translational movements are constrained, to vibrational energy loss in the body struck. Likewise, if the body is rotating about an axis to strike a stationary object, the maximum force will be imparted to the object of the point of impact coincides with the center of percussion. If the point of impact is displaced from the center of percussion less than the maximum force or energy is transmitted to the object.

When a golf club is suspended as shown in FIG. 6 by gimbals at a pivot point approximately five inches from the grip end and caused to freely swing in the plane perpendicular to the club face it is possible to empirically determine the center of percussion using the following equations, the terms of which are defined below:

$$I = \frac{T^2 \cdot mlg}{4\pi^2} \quad (25)$$

and $$L = \frac{I}{m \cdot l} \quad (26)$$

or substituting $$L = \frac{T^2 g}{4\pi^2} \quad (27)$$

where

I=moment of inertia of the club about axis of rotation

T=time constant (seconds per oscillations) measured empirically by counting the number of complete oscillations n in a given time period t, i.e., $$T=t/n$$

m=mass of club l=distance of center of gravity from pivot point g=gravitation constant (i.e., 32 ft/sec$^2$)

L=distance from pivot point to center of percussion.

What we have found is that clubs of the prior art design have a center of percussion located a distance L from the five inch point on the grip which is much less than the distance to the position on the club face which strikes the ball. That is, the center of percussion for these clubs is up the shaft above the usual point or zone of impact with the ball, which results in less than the maximum energy transfer from the club to the ball. What we have found experimentally, is that if an additional weight component $W_x$ is placed at grip end of the club, above the five inch pivot point, the distance L of the center of percussion from the pivot point is desirably increased, and moved closer to the actual point or zone of impact of the club head with the ball. This results in an overall increase in the amount of energy which can be transmitted to the ball. As will be appreciated by one skilled in this art, this additional energy can be used to achieve increased elevation or distance for any given club in the set. That is, the loft angle of a given club can be increased to provide greater elevation and the same distance, or if the loft angle is left unchanged the golfer will hit a longer ball than with the same club having a center of percussion further from the striking zone.

The efficiency of the energy transferal to the object struck is a function of the difference between the distance S, as measured from the pivot point to the point of impact, and the distance L as defined above. The closer the center of percussion is to the point of impact the more efficient will be the transfer of available kinetic energy from club to ball.

As we have stated above, the additional weight component $W_x$ placed at the grip end of the shaft has been found to increase the distance L, moving the center of percussion closer to the actual point or zone of impact of the club face with the ball which thereby increases the overall club efficiency and provides for greater energy transfer to the ball. Moreover, for a given true swing weight a club with weight component $W_x$ located above the five inch point in the grip end will have a lower center of percussion than a club of conventional design which has the same swing weight. As will also be appreciated from the previous discussion, weight can be added to the club head, and properly counter-balanced by weight $W_x$ without changing the true swing weight. Such additional weighting of the club head will also produce the desirable result of lowering the center of percussion toward the point or zone of impact of the club head with the ball.

A golfer's existing set of clubs will provide improved performance by addition of a weight component at the grip end of the shaft, counter-balanced by the addition of a somewhat lesser weight in the head. Empirical tests and theoretical calculations can be utilized to determine the amount and placement of weights so that the pre-existing swing weight is maintained, although the total weight of the club will be increased. The result of this modification being to lower the club's center of percussion and thereby improve the efficiency of the club as a striking implement, the golfer will be able to impart more energy to the ball for a given swing than he would with the unmodified club.

The effect of the additional weight component $W_x$ in moving the center of percussion downward toward the zone or point of impact is shown in Chart III below, for representative conventional clubs selected from the woods and irons. For each club, the first row across the chart indicates the swing weight and location of the center of percussion before any modification. The second row indicates the respective changes by addition of the additional weight component $W_x$, and the third row shows the further advantageous change in the location of the center of percussion when the original swing weight is restored by adding weight to the head. All of the symbols used in the Chart III are defined following equation (27) above. The last column of Chart III shows that the location of the center of percussion as measured from the grip end of the shaft, the distance L+5, moves toward the fixed zone of impact located in the club head, approximately at the end of the club shaft.

A further control problem is created by the radial acceleration and precessional forces which develop in Phase II of the swing. Since the center of gravity of the club lies outside the axis of the shaft when the club head is rotated by the golfer in Phase II a force developes which tends to move the shaft downward and out of the swing plane. In the clubs of the prior art the golfer must compensate totally for this additional force, which is further complicated by flexing of the shaft in a downward direction. By analysis of the forces acting on the club head and shaft we have found that the additional weight component $W_x$ properly positioned in the grip end of the shaft will produce a countering force to these precessional forces. The countering force acts to neutralize or reduce the forces transmitted to the golfer's hands.

| Club | TRUE SWING WEIGHT (5") | SHAFT LENGTH inches | $W_x$ gms. | $\Delta W_h$ gms. | n | t sec. | T | L inches | L + 5 inches |
|---|---|---|---|---|---|---|---|---|---|
| WOODS | | | | | | | | | |
| #1 | 23.65 | 43 | 0 | 0 | 124 | 238.8 | 1.9258 | 36.0728 | 41.0738 |
| " | 22.90 | 43 | 80 | 0 | 123 | 240.0 | 1.9512 | 37.0317 | 42.0317 |
| " | 23.65 | 43 | 80 | 7.5 | 123 | 240.8 | 1.9577 | 37.2768 | 42.2768 |
| IRONS | | | | | | | | | |
| #3 | 24.9 | 38.25 | 0 | 0 | 132 | 239.0 | 1.8106 | 31.8871 | 36.8871 |
| " | 24.6 | 38.25 | 30 | 0 | 131 | 239.0 | 1.8244 | 32.3750 | 37.3750 |
| " | 24.9 | 38.25 | 30 | 3.5 | 132 | 241.2 | 1.8273 | 32.4780 | 27.4780 |

The obvious beneficial result is that the golfer must exert a lesser force through his own hands to control the club during the critical Phase II of the swing. This desirable countering force will be maximized if the weight $W_x$ is placed as close as possible to the end of the grip end of the shaft, and displaced as far as possible from the axis of the shaft in the same direction as the club head.

Again, as we have stated above, the selection and placement of the additional weight component $W_x$ can be undertaken individually or in conjunction with the maintaining of the constants of total club weight, true swing weight and center of gravity on the club shaft at a fixed distance from the tip of the grip end of the shaft.

In all of the above examples and in the drawings accompanying this specification the additional weight component $W_x$ is for convenience indicated to be a separate component in the construction of the club. As we have also stated it is the practice in construction of the prior art clubs to use a standard uniform grip component for all clubs in a particular set. These grips can be made of leather, rubber or from synthetic materials. It will be apparent that our invention as described and claimed can be practiced by incorporating the additional weight component of suitable form in a grip component of appropriate design. Grip components would then necessarily be of non-uniform weight or density but still uniform in appearance. For example, lead tape and lead filings can be introduced into the molding composition for the grips to provide components of varying weights and weight distributions, which would produce the same result or effect as the separate weight component $W_x$.

In the manufacture of clubs meeting the design parameters which we have established as our invention it will be advantageous to provide means for readily adjusting the weights of the various components making up the clubs. The shafts used will generally be of the same configuration and material and will vary from one club to another only in length. Grips are generally standardized for all clubs in the set. The components in which principal adjustments will be made will therefore be in the head and the additional weight component $W_x$. Various means are well known in the art for varying club head weight, including boring a circular hole in the head and inserting discs of varying densities to achieve the desired weight and then securing these discs with a threaded plug, epoxy material or other sealing means which will not detract from the appearance of the finished club. Such weights are often secured under the sole plate in the woods.

However, the placing of an additional weight component in the grip end of the shaft in accordance with the teaching of our invention is novel and suitable means are therefore not known in the art for positioning this weight component.

Figure 8:
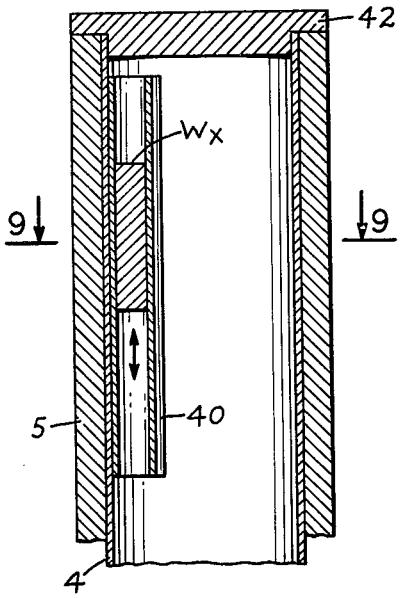
FIG. 8 is a side elevational cross-section of the grip end of a golf club showing one embodiment of a weighting device disposed therein.
Figure 9:
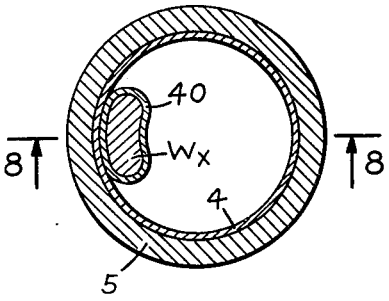
FIG. 9 is a sectional view of the embodiment illustrated in FIG. 8, taken on line 9—9 thereof.

FIGS. 8 and 9 illustrate one embodiment of a means which permits fixing the position of the center of gravity of weight $W_x$ with respect to its radial displacement from the longitudinal axis of the shaft and to the plane through the shaft axis and club center of gravity, while still permitting its displacement in a direction parallel to the shaft axis.

Weight retaining sleeve 40 is appropriately positioned and permanently affixed to the inside of shaft 4 proximate the open grip end. Retaining sleeve 40 is designed with the same general cross-section as weight $W_x$, and of dimensions such that weight $W_x$ can be inserted into the sleeve, but is movable only under application of a force greater than that developed during the club swing. Sleeve 40 can be of nylon, PVC or other rigid plastic material, and can be affixed to the shaft by epoxy or other suitable adhesives. The cross-section of the weight $W_x$ and hence the sleeve can be determined on the basis of the materials readily available. Materials of varying density can be advantageously used to obtain the balancing or matching of total club weight, true swing weight and center of gravity in accordance with our invention. Rods, bars and strips of various sizes are readily available through commercial sources. In addition, weight $W_x$ can be of semi-circular, crescent or other arbitrary cross-section in order to obtain an optimum location of its center of gravity.

Once sleeve 40 has been affixed to the inside of shaft 4 and the weight $W_x$ of appropriate material inserted, cap 42 is put in place over the end of the shaft and grip 5. Preliminary balancing measurements can then be taken, and the position of the weight $W_x$ adjusted to obtain precise balancing and matching.

Figure 10:
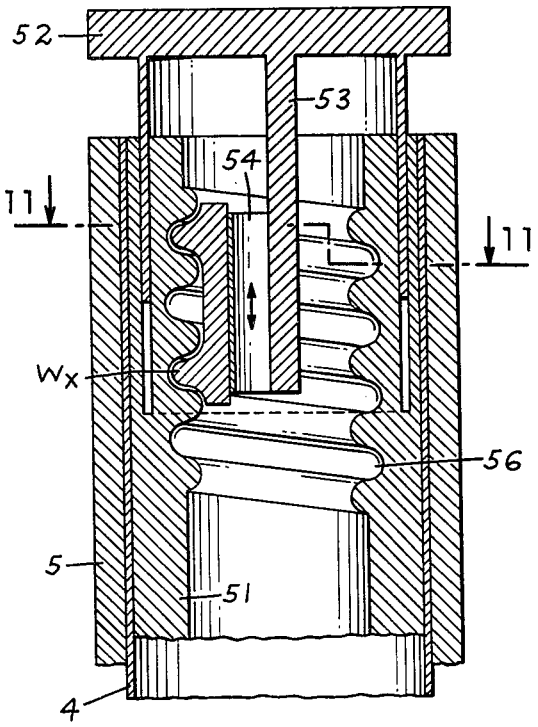
FIG. 10 is a side elevational cross-section of the grip end of a golf club showing a further embodiment of an adjustable weighting device disposed therein.
Figure 11:
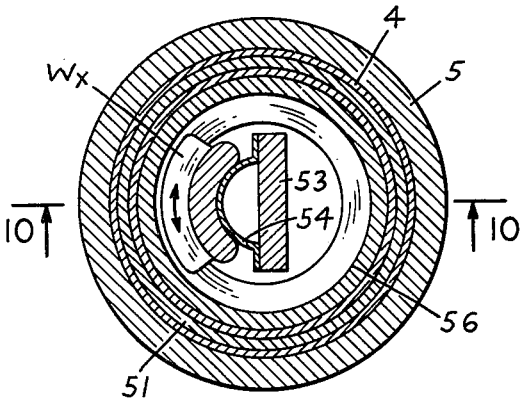
FIG. 11 is a sectional view of the embodiment illustrated in FIG. 10, taken on line 11–11 thereof.

FIGS. 10 and 11 illustrate an embodiment of means for externally adjusting the position of the component weight $W_x$ within the shaft of the club. Spirally slotted sleeve 51 is rigidly fixed within shaft 4 at the grip end, and weight $W_x$ is movably mounted in the grooves. A rotatable cap 52, having a flat blade or paddle 53 projecting from its underside is mounted on the end of the shaft proximate to the grip 5. The blade 53 is of a width sufficient to contact $W_x$ when cap 52 is rotated. A resilient member 54 is affixed to blade 53 and contacts $W_x$ to maintain it in position against the slots of sleeve 51. As can be seen from the drawing, when the rotating blade contacts the weight $W_x$ the weight is caused to rotate about the axis of the club shaft and also is displaced in a direction parallel to the longitudinal axis of the shaft, the direction of movement being determined by the direction of rotation of cap 52 and the configuration of the spiral grooves 56 in sleeve 51.

We claim:

1. A method of minimizing or eliminating the axial torquing forces exerted on the shaft of a moving golf club, the club being an iron or wood, which club consists of a shaft, a grip and a club head immovably affixed thereto which method comprises affixing to the club shaft an additional weight component $W_x$ at a position which is radially displaced from the longitudinal axis of the club shaft, proximate to the grip end of the shaft, and not extending beyond the surface of the grip, the center of gravity of said additional weight component lying in the plane defined by the longitudinal axis of the shaft and the center of gravity of the club, and on the same side of the shaft as the club head.

2. The method of claim 1 which further comprises determining the original swing weight of the club before the additional weight component $W_x$ is affixed to the club shaft, and increasing or decreasing the total weight of the club head to restore the original swing weight of the club after affixing the weight component $W_x$.

3. A method of minimizing or eliminating during use, the axial torquing forces exerted on the shafts of a set of golf clubs, where the set consists of a plurality of irons or woods, or both, wherein each of the clubs in the set has a shaft of different length, a grip and a club head immovably affixed thereto with each of said club heads having a unique loft angle, said set without designed incremental differences in total weight between the clubs comprising the set, all of which are balanced and matched to each other to have substantially the same (a) swing weight for all of the clubs in the set as measured about a fulcrum located between the center of gravity and the tip of the grip end of the club shaft when said fulcrum is located at the same distance from the tip of the grip end for each of the clubs in the set, (b) total weight; and (c) have their center of gravity as measured on the club shaft, at approximately the same distance from the tip of the grip end of the shaft, which method comprises affixing to the shaft of each club in the set an additional weight component $W_x$ at a position which is radially displaced from the longitudinal axis of the club shaft, proximate to the grip end of the shaft and not extending beyond the surface of the grip, the center of gravity of said additional weight component lying in the plane defined by the longitudinal axis of the shaft and the center of gravity of the club, and on the same side of the shaft as the club head, the position and weight of $W_x$ being determined for each club in the set to eliminate or minimize the axial torquing forces produced by the moving club head.

4. A method of improving the striking efficiency of a golf club which club consists of a head, a shaft and a grip, which consists of (a) determining the original swing weight of the club, (b) affixing an additional weight component $W_x$ to the club shaft at a distance which is less than about five inches from the tip of the grip end of the shaft, and (c) increasing the weight of the club head in proportion to that of the additional weight component $W_x$ to restore the original swing weight of the club, to thereby move the center of percussion of the club in the direction of the zone of impact of the club head with the ball.

5. A set of golf clubs consisting of a plurality of irons or woods, or both, wherein each of the clubs of the set contains an additional weight component $W_x$ independently affixed within the club shaft at a longitudinal position which is less than about five inches from the tip of the grip end of the shaft to optimize the location of the center of percussion of each club, and all of the clubs in the set are balanced and matched to each other to have substantially the same (a) swing weight for all of the clubs in the set as measured about a fulcrum located between the center of gravity and the tip of the grip end of the club shaft when said fulcrum is located at the same distance from the tip of the grip end for each of the clubs in the set, (b) total weight; and (c) have their center of gravity as measured on the club shaft, at approximately the same distance from the tip of the grip end of the shaft.

* * * * *